US006345863B1

(12) United States Patent
Laws et al.

(10) Patent No.: US 6,345,863 B1
(45) Date of Patent: Feb. 12, 2002

(54) FOLDING CHAIR WITH LUMBAR SUPPORT AND FLEXIBLE BACK SUPPORT

(75) Inventors: David J. Laws, Provo; Richard D. Smith, Springville, both of UT (US)

(73) Assignee: Miny-Lite, Inc., Orem, UT (US)

( * ) Notice: Subject to any disclaimer, the term of this patent is extended or adjusted under 35 U.S.C. 154(b) by 0 days.

(21) Appl. No.: 09/425,596

(22) Filed: Oct. 22, 1999

(51) Int. Cl.[7] ..... A47C 4/00

(52) U.S. Cl. ..... 297/56; 297/452.3; 297/447.2

(58) Field of Search ..... 297/56, 55, 452.3, 297/284.2, 183.5, 447.2, 452.33, 284.1, 452.18

(56) References Cited

U.S. PATENT DOCUMENTS

| | | | | |
|---|---|---|---|---|
| 128,767 | A | | 7/1872 | Viele |
| 169,748 | A | | 11/1875 | Wakefield |
| 198,421 | A | | 12/1877 | Smith |
| 473,704 | A | | 4/1892 | Le Count |
| 779,327 | A | | 1/1905 | Stiggleman |
| 945,032 | A | | 1/1910 | Gillespie |
| 976,786 | A | | 11/1910 | Moulin |
| 1,591,550 | A | | 7/1926 | Rosenthal |
| 1,740,806 | A | * | 12/1929 | Clarin |
| 1,975,622 | A | | 10/1934 | Schermerhorn |
| 2,303,189 | A | | 11/1942 | Adler |
| 2,514,125 | A | | 7/1950 | Evans |
| 2,568,269 | A | | 9/1951 | Burnham et al. |
| 2,874,755 | A | | 2/1959 | Smith |
| 3,087,755 | A | | 4/1963 | Boman |
| 3,220,764 | A | | 11/1965 | Duer |
| 3,639,001 | A | | 2/1972 | Anderson |
| 3,669,496 | A | | 6/1972 | Chisholm |
| 3,695,687 | A | * | 10/1972 | Uyeda |
| 4,235,473 | A | | 11/1980 | Aginar |
| 4,319,779 | A | | 3/1982 | Leonhart |
| 5,040,848 | A | | 8/1991 | Irie et al. |
| 5,071,191 | A | | 12/1991 | Leib |
| 5,096,259 | A | | 3/1992 | Stanfield |
| 5,383,712 | A | | 1/1995 | Perry |
| 5,825,095 | A | | 10/1998 | Albecker, III |
| 5,860,700 | A | * | 1/1999 | Lance |

* cited by examiner

*Primary Examiner*—Milton Nelson, Jr.
(74) *Attorney, Agent, or Firm*—Thorpe North & Western

(57) ABSTRACT

A folding chair has a support frame with a back support portion, front leg portions, and rear legs. A seat is pivotally coupled to the support frame. A flexible back support is coupled to the support frame, and has a lumbar support member extending down from the back support to reach a lumbar region of a user's back. The lumbar support member extends from the back support into a space between the back support and seat. The seat pivots in a downward direction away from the back support and lumbar support ID member, so that the seat folds without interfering with the lumbar support member. The back support also has a perimeter flange disposed across the rigid back support perimeter, and free to move with respect to the rigid support frame in response to a load applied to the flexible back support. The perimeter flange extends across a gap created between the flexible back support and the support frame, such that when a load is applied to the back support and the back support flexes, causing the gap to open, the perimeter flange conceals the gap as the flexible back support goes from a loaded position to an unloaded position, thereby preventing pinching of articles of clothing or skin of a user.

25 Claims, 5 Drawing Sheets

FOLDING CHAIR WITH LUMBAR SUPPORT AND FLEXIBLE BACK SUPPORT

BACKGROUND OF THE INVENTION

1. The Field of the Invention

The present invention relates generally to a folding chair, and/or a stackable/storable folding chair system. More particularly, the present invention relates to a folding chair having a flexible back support which displaces under a user's weight for comfort, and having a lumbar support member extending downwardly from the back support to the lumbar region of the user's back.

2. The Background Art

Folding chairs are often used in situations in which it is desirable or necessary to provide varying numbers and/or varying layouts of chairs, such as during conventions, seminars, conferences, etc. In addition, folding chairs are often used in multipurpose areas in which patron seating is required for some functions, but a large open space is required for other functions necessitating storage of the chairs. For example, some organizations have buildings with a multipurpose room which may be used for banquets, seminars, conventions, etc., with chairs set up, or for a dance, sporting event, etc., with the folding chairs removed.

It is desirable that the folding chairs be capable of being folded and stacked for storage so that the chairs take up less room when they are not required. It will be appreciated that some situations or events will require thousands of folding chairs, all of which may need to be folded and stored at any given period. Thus, the chairs must be folded and stored such that they have a high storage density to minimize the storage space required. It will be appreciated that any extra thickness of a chair when folded becomes significant when numerous folding chairs are involved. For example, with a thousand stacked folding chairs, a folding chair which saves one extra inch in the folded position results in over 80 linear feet of saved storage space.

One disadvantage with many prior art folding chairs is the bulk or thickness of the chair in the folded position. Many typical folding chairs still remain several inches thick in the folded position, and thus are less dense when stored. For example, many typical folding chairs have seats which fold adjacent to or abutting the legs, and/or have front and back legs which fold against one another, such that the thickness of the chairs in the folded position comprises the thickness of both the front and rear legs, and/or the thickness of the legs and the seat. Another disadvantage of many conventional folding chairs is that they fold awkwardly, with bulky folded configurations and/or various protruding members.

In addition, it is desirable that the folding chairs be easily storable or stackable, and be stable when stored/stacked. Many typical prior art folding chairs are stored merely by leaning one chair against a wall and subsequent chairs in a series against the first chair. It will be appreciated that a plurality of folding chairs stacked against a wall have a potential domino effect, with all of the chairs subject to being knocked over. Other prior art folding chairs have complicated and expensive hanging rack systems. For example, a wheeled cart might have a plurality of support arms from which a plurality of folding chairs are suspended. One disadvantage of these types of systems is that chairs on the end of the hangers tend to fall off the rack, and the wheeled racks are difficult to move and maneuver.

Some types of prior art folding chairs have back rest portions which protrude from the chair and into an adjacent folding chair. For example, a folding chair may have a back portion which curves outwardly to protrude from the frame of the chair, and into the frame of and adjacent folding chair. Although this relationship allows the chairs to be stored with greater density, the chairs tend to be unstable in a stored position. The broad rounded backs of the chairs act as ramps which fail to resist movement of an adjacent chair. In addition, the chairs are still relatively thick and bulky.

It also is desirable that the chairs be easy to set up and take down, or fold and unfold. It will be appreciated that there is considerable time involved in setting up and taking down thousands of chairs. One disadvantage of many prior art folding chairs is that they are difficult to both unfold and fold. For example, most folding chairs require the person to use both hands to fold and unfold the chair. One hand usually has to grasp the back of the chair while the other hand has to grab and pivot the seat in or out.

It also is desirable that the chairs be comfortable. Typical prior art folding chairs have rigid metal seats and seat backs which can be hard and uncomfortable. One disadvantage of many prior art folding chairs is that the chairs either fold well and are uncomfortable, or are comfortable, but are awkward in folding. Thus, there tends to be a trade off between comfort and foldability. Some chairs provide a cushion. But these chairs still utilize the rigid metal seat bottoms and seat backs, and the cushions tend to make the chairs even thicker when folded.

In addition, it is desirable that the chair provide proper id support, or be ergonomically designed. One disadvantage of many prior art chairs is that the angle between the back rest and the seat is dictated by the folding mechanism of the chair. Thus, in an effort to create a folding chair, the proper ergonomic design of the back rest and seat is often compromised in order to obtain a chair that folds more easily.

Another disadvantage of many typical prior art folding chairs is that they have a relatively small back support which may not adequately support a user's back. The small back support is often a function of the folding configuration of the chair. Again, the back support is often compromised in order to obtain a chair that folds. For example, the seat may be configured to fold upwardly or towards the back support, so that a relatively large space must exist between the back support and the seat so that the seat may fold into that space. That space is usually located where a user requires back support.

It also is desirable that the folding chair be durable. It will be appreciated that the chair will be alternately stored and used, folded and unfolded, innumerable times. Similarly, it is desirable that the folding chair be strong. The chair must be able be to support persons of various weight, often in potentially abusive conditions.

It also is desirable that the folding chair be safe. It will be appreciated that as the various parts of the chair fold, there is a potential for fingers and the like to become pinched within the folding mechanisms.

Therefore, it would be advantageous to develop a folding chair capable of folding for high density storage, as well as being comfortable and providing proper support. It also would be advantageous to develop such a folding chair which is more stable and safe in the folded and stored position. It would further be advantageous to develop a folding chair which (i) may easily be folded and unfolded; (ii) is comfortable and safe; and (iii) is durable, strong, and cost effective.

OBJECTS AND SUMMARY OF THE INVENTION

It is therefore an object of the present invention to provide a folding chair which is comfortable, and folds relatively thin to maximize storage density.

It is therefore an object of the present invention to provide a folding chair which provides proper support.

It is another object of the present invention to provide such a folding chair which stores safely and is stable when stored, and/or stacked.

It is another object of the present invention to provide a folding chair which is easily folded and unfolded.

It is yet another object of the present invention to provide a folding chair which is safe and comfortable.

It is yet another object of the present invention to provide a folding chair which is durable, strong, and cost effective.

The above objects and others not specifically recited are realized in a specific illustrative embodiment of a folding chair having a flexible back support with a lumbar support member, and with a perimeter flange protruding from a front surface of the back support and extending across a front portion of a support frame. The support frame has a back support portion, front leg portions, and rear legs. A seat is pivotally coupled to the support frame.

The flexible back support is coupled to the support frame. The back support is flexible and displaces in response to the user's weight.

In accordance with one aspect of the present invention, the back support has a lumbar support member extending down from the back support to reach a lumbar region of a user's back. The lumbar support member extends from the back support into a space between the back support and seat. The seat preferably pivots in a downward direction away from the back support, and the lumbar support member, such that the seat folds without interfering with the lumbar support member. In addition, the lumbar support member preferably has a horizontal concave curvature integrally formed with a vertical convex curvature to support a user's lumbar region, and to provide several comfortable seating positions. Thus, the lumbar support is unique to folding chairs.

In accordance with another aspect of the present invention, the flexible back support has a perimeter flange protruding from a front surface of the back support, and extending across a front portion of the support frame. The perimeter flange displaces across the front portion of the support frame in proportion to a load applied to the back support, thus allowing the back support to flex and conform to a user. The perimeter flange extends across a gap created between the flexible back support and the support frame. Thus, when a load is applied to the back support and the back support flexes, causing the gap to open, the perimeter flange conceals the gap as the flexible back support goes from a loaded position to an unloaded position. Therefore, the perimeter flange advantageously prevents pinching of articles of clothing or skin of a user.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
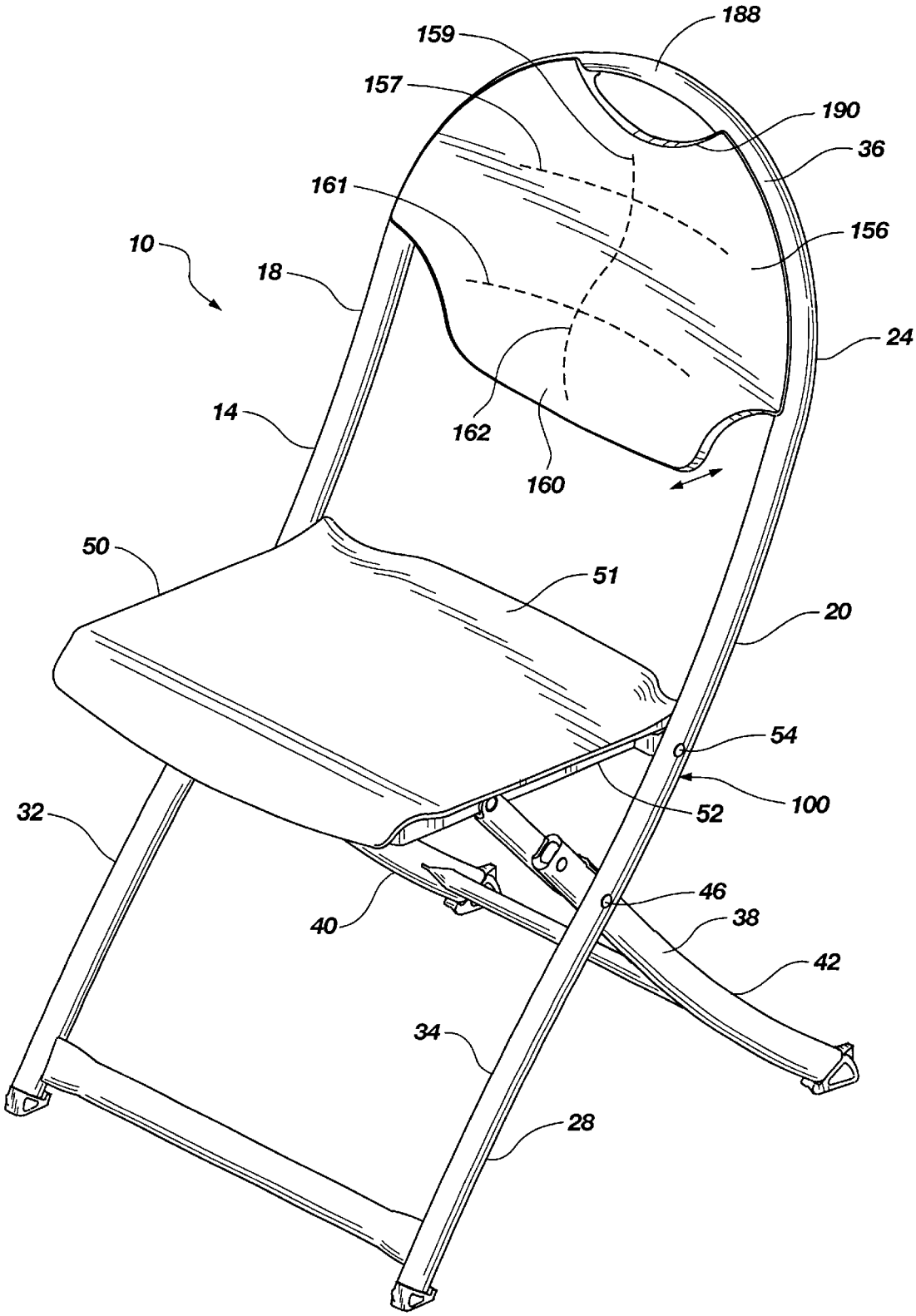
FIG. 1 is a perspective view of a preferred embodiment of a folding chair in accordance with the present invention in a first open unfolded position.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

As illustrated in FIG. 1, a folding chair, indicated at 10, in accordance with the present invention, is shown in a first, open, unfolded orientation or position. The folding chair 10 advantageously has a flexible back support 156, and a lumbar support member 160, as discusses more fully below.

Figure 3:
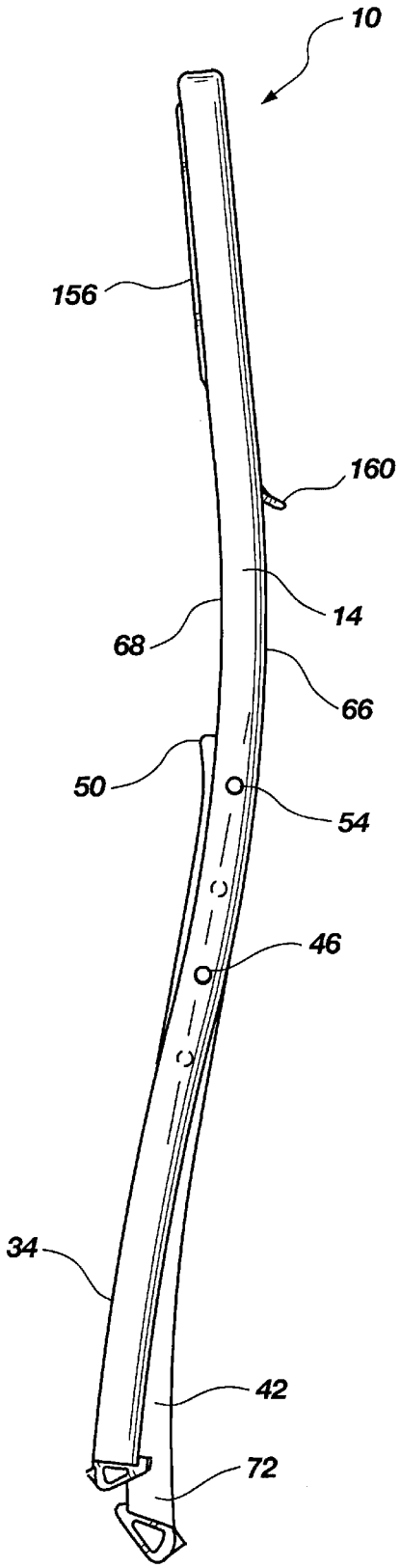
FIG. 3 is a side view of the preferred embodiment of the folding chair of the present invention in a second closed folded position.
Figure 4:
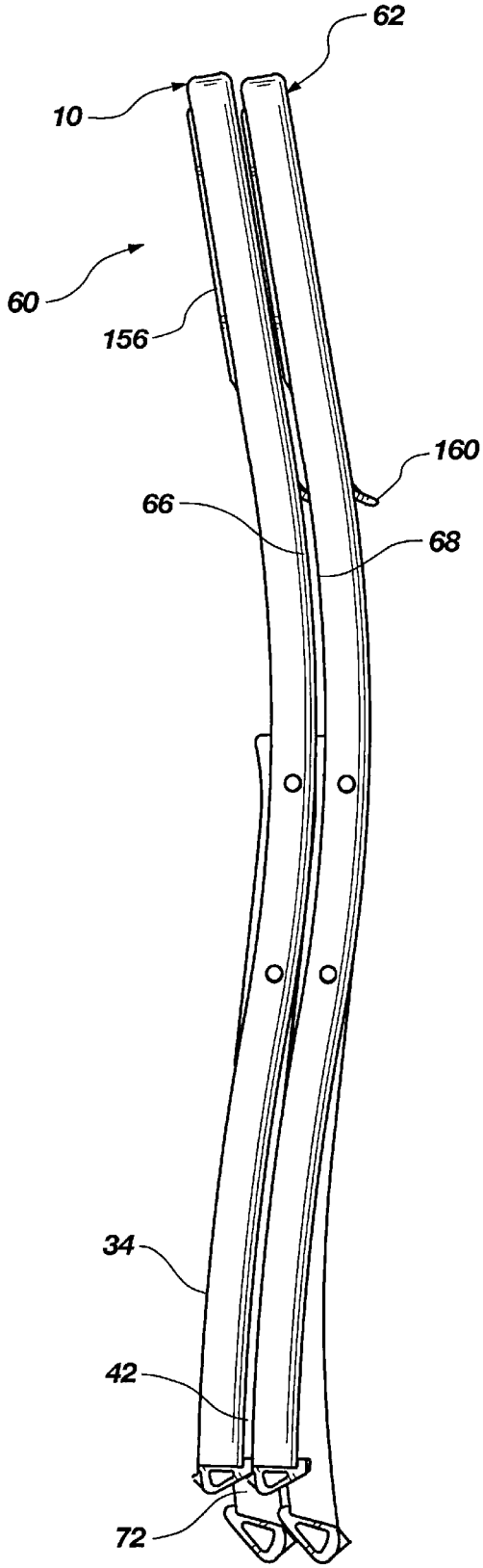
FIG. 4 is a side view of the preferred embodiment of a storable/stackable folding chair system of the present invention showing two folding chairs in the folded position which are disposed adjacent one another in a nesting or indexing relationship.
Figure 5:
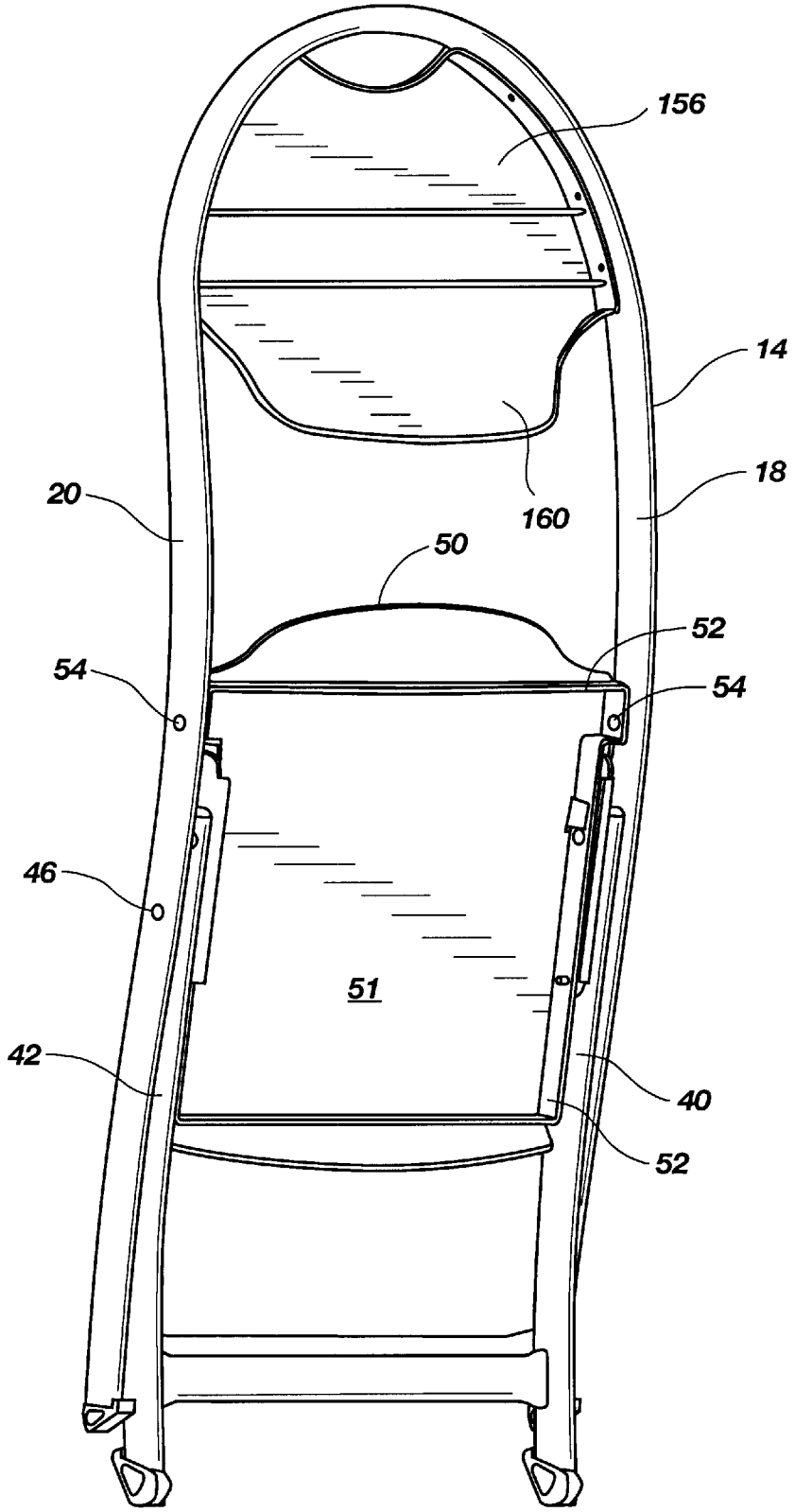
FIG. 5 is a perspective view of the preferred embodiment of the folding chair in accordance with the present invention shown in the closed, folded position.

As indicated above, typical prior art chairs fold into a thick, awkward or bulky shape or configuration, or have significant protruding members, such that typical prior art folding chairs are less dense when stored, and require more space for storage. The folding chair 10 of the present invention utilizes a new approach in which the chair 10 is designed or configured to fold or collapse into a minimum thickness, such that the chairs 10 of the present invention have a very high storage density, while still providing strength, comfort, and durability. Thus, when folded, the chair 10 of the present invention advantageously is thin or presents a minimal profile, as shown in FIG. 3. In addition, the thin profile of the chair 10 advantageously is shaped or configured to facilitate nesting or indexing with adjacent chairs, as shown in FIG. 4.

Also as discussed above, typical prior art chairs are hard, uncomfortable, and fail to provide adequate back support. The folding chair 10 of the present invention utilizes a new approach in which the chair 10 is designed or configured to provide self-adjusting back support, and lumbar support, while still providing a folding chair which folds thinly and may be stacked with high density and stability.

The shape of the thin profile of the chair of the present invention 10 may take various configurations, as described in co-pending U.S. patent application Ser. No. 09/425,586, filed Oct. 22, 1999, which is herein incorporated by reference.

Figure 2:
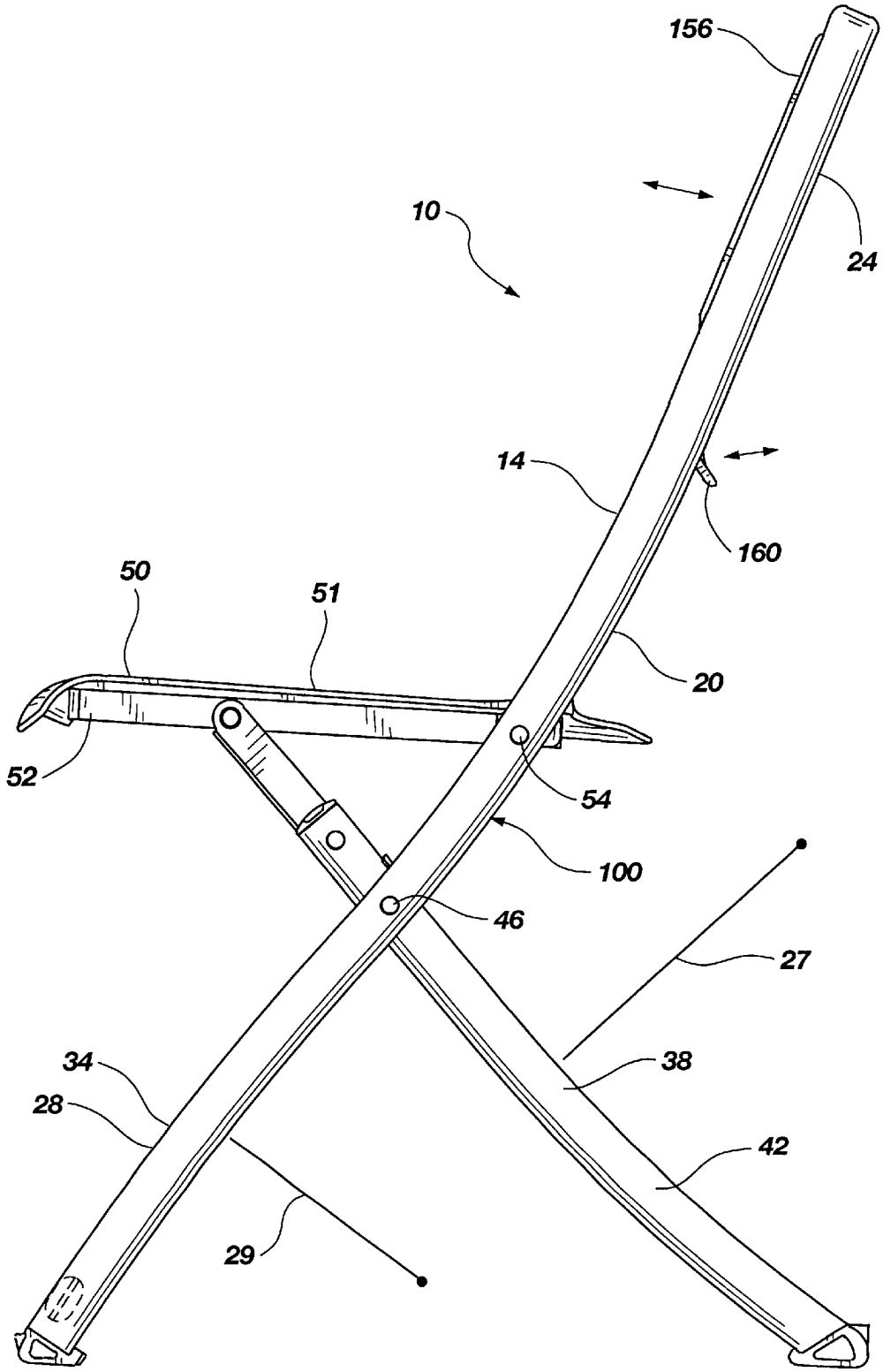
FIG. 2 is a side view of the preferred embodiment of the folding chair in accordance with the present invention in the first open unfolded position.

Referring to FIGS. 1 and 2, the folding chair 10 has a rigid support frame 14 including left and right, or first and second, rigid side supports 18 and 20, as shown in FIG. 1. As indicated above, it is desirable that the chair 10 be durable and strong. Thus, the rigid nature of the support frame 14 increases the durability and strength of the chair 10.

Preferably, the support frame 14 is formed from a tubular material to optimize strength and weight. In addition, the tubular material preferably has an elongated cross-sectional shape which is oriented generally vertically to increase the weight capacity of the chair 10. Furthermore, the tubular material preferably has rounded corners, or most preferably has an oval cross-sectional shape, giving soft edges to the frame 14 which are more comfortable.

The support frame 14, and side supports 18 and 20, have an upper back support portion 24 forming the back of the chair 10, and a lower front leg portion 28 formed integrally and continuously with the upper back support portion 24. The back support portion 24 extends forwardly from the back of the chair 10 to the lower front leg portions 28. Thus, the first and second side supports 18 and 20, or the upper and lower portions 24 and 28 thereof, are unitary, integral, and rigid structures to increase strength and durability. The front leg portion 28 preferably includes left and right, or first and second, front legs 32 and 34. In addition, the support frame 14, or side supports 18 and 20, may be a single integral member with a broad curved back member 36 formed at the tops of the side supports 18 and 20, as shown.

As indicated above, the rigid support frame 14 preferably is shaped to form a curved spline profile. As used herein, the term "curved spline" is used broadly to describe an elongated member with at least a curved portion, and which may include multiple curves and/or straight portions as well. The profile is an elongated continuous profile having a substantially uniform thickness which is relatively thin when all elements are collapsed within the profile. The thin uniform profile contributes to a higher storage density of the chairs.

The chair 10 also includes a rear leg portion 38, which preferably includes left and right, or first and second, rear legs 40 and 42, as shown in FIG. 1. The rear leg portion 38, or rear legs 40 and 42, are pivotally coupled to the support frame 14 at leg pivot points 46. The leg pivot points 46 are preferably fixed pivot points, such that the rear legs 40 and 42 pivot with respect to the support frame 14 or front legs 32 and 34.

In addition, the chair 10 includes a seat or seat portion 50 pivotally coupled to the support frame 14, and between the side supports 18 and 20 at seat pivot points 54. Again, the seat pivot points 54 are preferably fixed pivot points such that the seat 50 pivots with respect to the support frame 14, rather than sliding. The seat 50 and rear legs 40 and 42 also are pivotally connected as discussed in greater detail below.

The seat 50 may comprise a seating surface 51 secured to a seat frame 52. The seat frame 52 may extend generally around the perimeter of the seat 50, or along the sides, front and back of the seat 50. This provides an advantage where the seat may flex in response to a load, as discussed below. The seating surface 51 is disposed on the seat frame 52, and spans the distance between the perimeter of the frame 52. Preferably, the seating surface 51 is formed of a flexible material, and flexes, bends, or deflects downwardly and into the seat frame 52 in response to, and proportional to, a user's weight. The flexibility of the seating surface 51 is enabled because of the perimeter location of the seat frame 52, and allows the seating surface 51 to cup or curve, and thus conform to the user for a custom fit. In addition, the seating surface 51 preferably is coupled to the seat frame 52 only at the front and back, and not at the sides, to further allow the seat surface 51 to deflect.

The seat 50 and rear legs 40 and 42 pivot with respect to the support frame 14 between (i) the first, open, unfolded position, as shown in FIGS. 1 and 2, and (ii) the second, closed, folded position, as shown in FIG. 3.

Referring to FIG. 3, the seat 50 and rear legs 40 and 42 advantageously pivot such that a majority of the seat 50 and a majority of the rear legs 40 and 42 collapse within a volume defined by the support frame 14. In addition, a majority of the back support 156 is contained within the volume of the support frame 14. Thus, in the folded position, the chair 10 substantially maintains the curved spline profile of the support frame 14. The chair 10 (or the support frame 14, seat 50 and rear legs 40 and 42) also advantageously has a curved spline profile in the closed position, with the profile having a substantially uniform thickness which is relatively thin. The volume defined by the support frame 14 is the space between the side supports 18 and 20. Thus, the seat 50 and rear legs 40 and 42 pivot such that a majority of the seat 50 and rear legs 40 and 42 fold directly between the side supports 18 and 20.

The seat 50 and rear legs 40 and 42 collapsing within the volume of the frame 14, and the back support 156 being contained within the volume, provides a distinct advantage over prior art folding chairs, in which the seat and legs fold inwardly and onto the frame such that the frame, legs and seat form a relatively thick stack. In addition, the curved spline profile of the chair 10 in the folded position provides a distinct advantage over the prior art chairs, in which the profiles are straight and/or bulky. The chairs 10 of the present invention are capable of not only folding into a relatively thin profile in order to save storage space, but also forming a continuously and similarly shaped profile in which the profiles of adjacent chairs may be matched or nested to increase stability of the chairs in a stacked and stored relationship.

As illustrated in FIG. 4, a storable folding chair system, indicated generally at 60, may include a plurality of the above described chairs, including, for example, a first chair 10 and a second chair 62. The curved spline profile of the first folded chair 10 nests or indexes with the curved spline profile of the second folded chair 62 to resist relative motion of the two chairs 10 and 62 when disposed adjacent one another in an adjacent storage relationship. Referring again to FIG. 3, the curvature of the profile creates a protrusion or protruding portion 66 of the profile and an opposite matching indentation or recess 68 in the profile as the profile deviates from a straight line into a curvature. Thus, referring to FIG. 4, the protrusion 66 of the profile of the first chair 10 nests or indexes within the indentation or recess 68 of the profile of the second chair 62. Unlike many prior art folding chairs, which include a backrest portion which protrudes from the straight thick profile of the chair into the straight thick profile of an adjacent chair, the entire profile of the chair 10 of the present invention simultaneously forms the protrusions 66 and indentations 68 such that it is the entire profile of the chairs 10 and 62 which match to nest.

Referring again to FIGS. 1 and 2, the front legs 32 and 34 are preferably curved, and may be convex, as shown. The rear legs 40 and 42 are advantageously similarly curved so that the rear legs 40 and 42 may substantially collapse within the volume defined by the front legs 32 and 34. Both the front and rear legs 28 and 38 have a radius of curvature, with the radius of curvature 27 of the rear legs 40 and 42 being smaller than the radius of curvature 29 of the front legs 32 and 34. The smaller radius of curvature 27 of the rear legs 40 and 42 allows a greater portion of the rear legs 40 and 42 to collapse within the volume defined by the front legs 32 and 34.

Referring to FIG. 3, the smaller radius of curvature of the rear legs 40 and 42 also allows a portion of the bottom ends 72 of the rear legs 40 and 42 to protrude or extend outside the volume defined by the front legs 32 and 34. Although it is desirable to have a majority of the seat 50 and rear legs 40 and 42 collapse within the profile of the frame 14, the bottom ends 72 of the rear legs 40 and 42 extend outside of the volume of the front legs 32 and 34 to increase the stability of multiple stacked chairs. Referring to FIG. 4, it can be seen that the bottom ends 72 of the rear legs 42 of the first chair 10 protrude slightly from the profile, specifically of the front legs 34, of the first chair 10, and into the profile of the second chair 62. Therefore, the curved spline profile of the chairs 10 and 62 resists relative movement between the two chairs 10 and 62 in a longitudinal direction (or top to bottom direction), and the bottom end 72 of the first chair 10 protruding into the profile of the second chair 62 resists lateral relative motion (side-to-side) between the two chairs 10 and 62.

The folding chair 10 also includes left and right, or first and second folding systems, represented by the second or right folding system 100, formed by and pivotally coupling the frame 14, seat 50 and respective first and second rear legs 40 and 42 together. The folding system 100 allows the various components of the chair 10 to fold as thinly as possible in the folded position, and provides strength to the seat in the open position.

Referring again to FIG. 1, the chair 10 has a back support 156 coupled to the upper back support portion 24 of the support frame 14, and/or coupled to and between the side supports 18 and 20. The back support 156 is supported between the side supports 18 and 20, or the rigid frame 14. The back support 156 advantageously is flexible and bends or flexes inwardly or rearwardly as force is applied, such as when a person leans back against the back support 156. Thus, the back support 156 displaces or bends rearwardly in response to an amount of weight or force applied thereon, to provide an automatic response or adjustment, and to be more comfortable. Thus, the back support is self adjusting. The flexible back is a significant improvement over prior art folding chairs which have rigid metal backs, or inflexible backs.

In addition, the back support 156 advantageously includes a lower lumbar region 160 which extends downwardly from the back support 156 to a lumbar region of a user's back. The lower lumbar region 160 of the back support 156 is a significant advantage over prior art back rests. As indicated above, many typical prior art seats have a relatively small space between the seat and the back because the seat folds upward into the space below the back support. Thus, the back support of many prior art chairs tends to be a thin, high portion which only supports the upper region of a user's back, not the lumbar region. Because the seat 50 of the present invention folds downwardly and out of the way of the back support 156, the lumbar support member 160 is able to extend downwardly without interfering with the folding motion of the seat 50.

The lumbar support member or protrusion 160 is secured to the support frame 14 only through the back support 156, without being directly attached to the support frame 14, or side supports 18 and 20. Preferably, the lumbar support member 160 is integrally formed with the back support 156 and is similarly flexible so that the lower lumbar member may flex or move with respect to the back support 156 and with respect to the support frame 14. Therefore, not only does the entire back support 156 displace rearwardly in response to the user's weight, but the lower lumbar support member 160 itself displaces rearwardly with respect to the back support 156 to further provide a cushioning response to the user's lumbar region.

The back support 156 preferably is shaped to have a horizontally concave curvature 157 integrally formed with a vertically concave curvature 159. The lumbar support member 160 advantageously has a horizontally concave curvature 161 integrally formed with a vertical convex curvature 162 to provide support for the user's lumbar region. The lumbar support member 160 also may have a reduced cross sectional area for providing greater flexibility with respect to the back support 156. The concave and convex contour, along with the flexibility, allows for comfortable seating in both an upright, and a relaxed position of the user.

Figure 6:
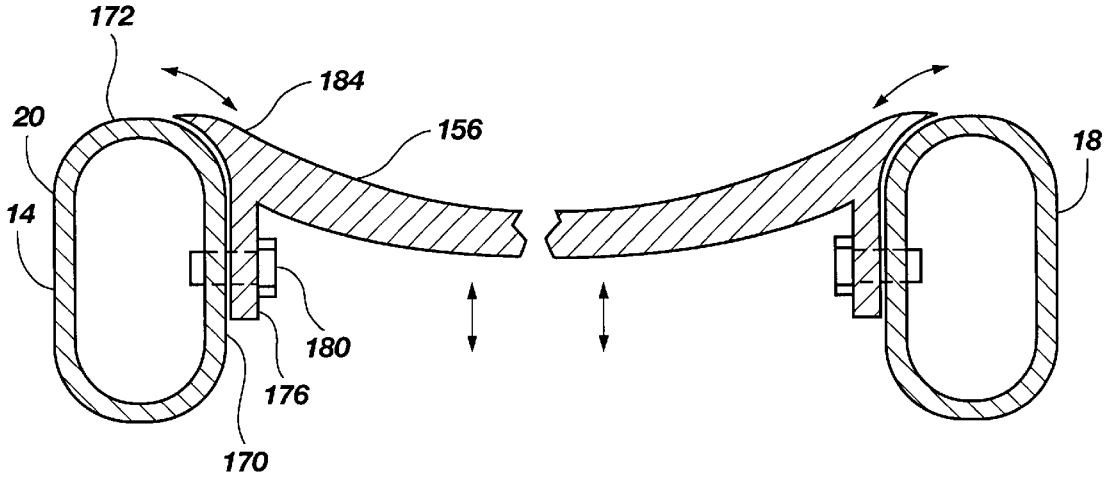
FIG. 6 is a partial cross sectional view of a preferred embodiment of a back support of the folding chair in accordance with the present invention.

Referring to FIG. 6, the support frame 14 has an inner surface 170 which faces into the volume defined by the frame 14, and a forward facing surface 172. The back support 156 extends between the inner surface 170 on the support frame, and across the forward facing surface 172 of the support frame 14, as described in greater detail below. The back support 156 has a rear flange 176 or protrusion extending from the back of the back support 156 rearwardly into the volume defined by the support frame 14. The rearward flange 176 is formed generally near the perimeter of the back support 156, and around at least a portion thereof, such that the rearward flange 176 also extends along a portion of the support frame 14 on either side, or along the side supports 18 and 20. Thus, the rearward flange 176 extends along the inner surface 170 of the support frame 14 on both sides. The back support 156 is attached to the support frame 14 by fasteners 180, such as rivets, bolts, screws, snaps, inserts, etc., which couple the rearward flange 178 to the inside or inner surface 170 of the support frame 14. Attaching the back support to the inner surface 170 of the support frame 14 allows the back support 156 to displace under a force, such as the user's weight.

The back support 156 advantageously also includes a perimeter flange 184 formed about at least a perimeter of the back support 156, and protruding or extending across a portion of the forward facing surface 172 of the support frame 14. The perimeter flange 184 advantageously extends over the gap or space formed between the back support 156, or rearward flange 176, and the support frame 14. As the back support 156 deflects rearwardly, the gap between the back support 156 and support frame 14 increases. The perimeter flange 184 advantageously displaces across the forward facing surface 172 of the support frame 14 as the back support 156 flexes rearwardly, allowing the back support 156 to flex while continuing to cover and conceal the gap. Thus, as the back support 156 returns to an unflexed position, the perimeter flange 184 prevents the back support 156 and support frame 14 from pinching any articles of clothing or skin which might otherwise have entered the gap.

Referring again to FIG. 1, the chair 10 may also have a handle 188 for a user to grasp the chair. As indicated above, the support frame 14, and thus the side supports 18 and 20, may be formed by a single integral member as shown. Thus, the handle 188 may be formed by the support frame itself at the top of the chair. Otherwise, additional support structures extending from the side supports 18 and 20 form the handle. In addition, an indentation 190 may be formed at the top of the back support member 156 such that a cavity or gap is formed between the top of the back support member 156 and the top of the support frame 14 for a user's fingers to extend through as the user grasps the handle 188.

As indicated above, the seat surface 51 may also be flexible and suspended between a perimeter seat frame 52.

Thus, the seat surface 51 also deflects in response to a user's weight, and to cup or curve, and thus conform to the user for a custom fit. Therefore, the flexible seat 50 and back support 156 combine to provide a chair 10 which is both comfortable and foldable.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A folding chair comprising:

a support frame having a back support portion and front leg portions;

a seat pivotally coupled to the support frame;

rear legs pivotally coupled to the support frame;

the seat and rear legs being pivotable between:

an open, unfolded position, and a closed, folded position; and a back support, coupled to the support frame, having a lumbar support member extending down from the back support configured to reach a lumbar region of a user's back; and the back support being flexible and displacing in response to the user's weight; and the back support having a perimeter flange protruding from a front surface of the back support and extending across a front portion of the support frame; and the perimeter flange displacing across the front portion of the support frame in proportion to a load applied to the back support.

2. The folding chair of claim 1, wherein a majority of the seat and a majority of the rear legs are collapsible into a volume defined by the support frame when in the closed, folded position.

3. The folding chair of claim 1, wherein the lumbar support member has a reduced cross-sectional area for greater flex.

4. The folding chair of claim 1, wherein the perimeter flange extends across a gap created between the flexible back support and the support frame, such that when a load is applied to the back support and the back support flexes, causing the gap to open, the perimeter flange conceals the gap as the flexible back support goes from a loaded position to an unloaded position, thereby preventing pinching of articles of clothing or skin of a user.

5. The folding chair of claim 1, wherein the lumbar support member has a horizontal concave curvature integrally formed with a vertical convex curvature.

6. The folding chair of claim 1, further comprising:

first and second folding systems for folding the folding chair from an opened unfolded position to a closed folded position.

7. The folding chair of claim 1, wherein the back support has a removed upper portion exposing a portion of the support frame to define a handle, such that the support frame may be grasped and used as a handle for lifting the folding chair.

8. The folding chair of claim 1, wherein the lumbar support member extends from the back support into a space between the back support and seat, and wherein the seat pivots in a downward direction away from the back support and lumbar support member, such that the seat folds without interfering with the lumbar support member.

9. The folding chair of claim 1, wherein the lumbar support member of the back support is laterally unattached to the support frame, but integrally connected to the back support.

10. A folding chair comprising:

a support frame having a back support portion and first and second side supports extending to form front leg portions;

a seat pivotally coupled to the support frame;

rear legs pivotally coupled to the support frame;

a flexible back support, coupled between the first and second side supports and having a protrusion extending downwardly from the flexible back support and defining a lumbar support member, the lumbar support member being secured to the support frame through the flexible back support without directly attaching laterally to the support frame, the lumbar support member being integrally formed with the flexible back support allowing the lumbar support member to flex with respect to the flexible back support and move with respect to the support frame; and a perimeter flange, protruding from a front surface of the back support and extending across a front portion of the support frame, configured to displace across the front portion of the support frame in proportion to a load applied to the back support.

11. The folding chair of claim 10, wherein a majority of the seat and a majority of the rear legs are collapsible into a volume defined by the support frame when in a closed, folded position.

12. The folding chair of claim 10, wherein the lumbar support member has a reduced cross-sectional area for greater flex.

13. The folding chair of claim 10, wherein the perimeter flange extends across a gap created between the flexible back support and the support frame, such that when a load is applied to the back support and the back support flexes, causing the gap to open, the perimeter flange conceals the gap as the flexible back support goes from a loaded position to an unloaded position, thereby preventing pinching of articles of clothing or skin of a user.

14. The folding chair of claim 10, wherein the lumbar support member has a horizontal concave curvature integrally formed with a vertical convex curvature.

15. The folding chair of claim 10, further comprising:

first and second folding systems for folding the folding chair from an opened unfolded position to a closed folded position.

16. The folding chair of claim 10, wherein the back support has a removed upper portion exposing a portion of the support frame to define a handle, such that the support frame may be grasped and used as a handle for lifting the folding chair.

17. The folding chair of claim 10, wherein the lumbar support member extends from the back support into a space between the back support and seat, and wherein the seat pivots in a downward direction away from the back support and lumbar support member, such that the seat folds without interfering with the lumbar support member.

18. A folding chair comprising:

a rigid support frame having a rigid back support perimeter and first and second side supports;

a seat, pivotally coupled to the support frame; and a flexible back support, coupled to the support frame, having a perimeter flange disposed across the rigid back support perimeter and free to move with respect to the rigid support frame in response to a load applied to the flexible back support; and a lumbar support member, attached to the back support, having a horizontal concave curvature integrally formed with a vertical convex curvature.

19. The folding chair of claim 18, wherein a majority of the seat is collapsible into a volume defined by the support frame when in the closed, folded position.

20. The folding chair of claim 18, wherein the perimeter flange extends across a gap created between the flexible back support and the support frame, such that when a load is applied to the back support and the back support flexes, causing the gap to open, the perimeter flange conceals the gap as the flexible back support goes from a loaded position to an unloaded position, thereby preventing pinching of articles of clothing or skin of a user.

21. The folding chair of claim 18, wherein the lumbar support member has a reduced cross-sectional area for greater flex.

22. The folding chair of claim 18, further comprising:

first and second folding systems for folding the folding chair from an opened unfolded position to a closed folded position.

23. The folding chair of claim 18, wherein the back support has a removed upper portion exposing a portion of the support frame to define a handle, such that the support frame may be grasped and used as a handle for lifting the folding chair.

24. The folding chair of claim 18, wherein the lumbar support member of the back support is laterally unattached to the support frame, but integrally connected to the back support.

25. The folding chair of claim 18, wherein the lumbar support member extends from the back support into a space between the back support and seat, and wherein the seat pivots in a downward direction away from the back support and lumbar support member, such that the seat folds without interfering with the lumbar support member.

* * * * *

UNITED STATES PATENT AND TRADEMARK OFFICE

CERTIFICATE OF CORRECTION

PATENT NO. : 6,345,863 B1
DATED : February 12, 2002
INVENTOR(S) : David J. Laws and Richard D. Smith It is certified that error appears in the above-identified patent and that said Letters Patent is hereby corrected as shown below:

Title page,
Item [73], Assignee to read: -- Mity-Lite, Inc. --

Signed and Sealed this

Twenty-sixth Day of November, 2002

*Attest:*

*Attesting Officer*

JAMES E. ROGAN
*Director of the United States Patent and Trademark Office*